US006470925B2

(12) United States Patent
Hyvärinen et al.

(10) Patent No.: US 6,470,925 B2
(45) Date of Patent: Oct. 29, 2002

(54) VACUUM SYSTEM

(75) Inventors: Jouni Hyvärinen, Helsinki (FI); Tommi Naski, Helsinki (FI)

(73) Assignee: Evac International Oy, Helsinki (FI)

( * ) Notice: Subject to any disclaimer, the term of this patent is extended or adjusted under 35 U.S.C. 154(b) by 0 days.

(21) Appl. No.: 09/898,690

(22) Filed: Jul. 5, 2001

(65) Prior Publication Data

US 2002/0046780 A1 Apr. 25, 2002

(30) Foreign Application Priority Data

Jul. 10, 2000 (FI) ..... 20001635

(51) Int. Cl.[7] ..... B65B 1/04

(52) U.S. Cl. ..... 141/65; 418/206.1; 141/67; 141/98

(58) Field of Search ..... 4/431–433; 141/65, 141/67–98; 418/206.1, 94

(56) References Cited

U.S. PATENT DOCUMENTS 3,035,274 A * 5/1962 Baughman ..... 241/185.6
5,318,415 A 6/1994 Verhoeven ..... 418/46
5,454,936 A * 10/1995 Ask et al. ..... 210/195.1
5,644,802 A 7/1997 Olin ..... 4/431
5,749,102 A * 5/1998 Duell ..... 4/321
6,174,152 B1 * 1/2001 Rokman et al. ..... 418/206.1
6,283,740 B1 * 9/2001 Brown ..... 277/527

OTHER PUBLICATIONS

Finnish Search Report: Dated Feb. 6, 2001—Finnish Patent Appl. 20001635.

* cited by examiner

*Primary Examiner*—Steven O. Douglas
(74) *Attorney, Agent, or Firm*—Marshall, Gerstein & Borun

(57) ABSTRACT

The invention relates to a method for transporting sewage in a vacuum system, which comprises a source (2) of sewage, which through sewer piping (1) is connected to a collecting or discharge space (15) for sewage, and means (4,5) for generating vacuum in the sewer piping (1). In order to attain a reliably operating system the method employs a rotary lobe pump (4,5) for generating vacuum, transported through the rotary lobe pump (4,5) to the collecting or discharge space (15) for sewage. The rotary lobe pump can also be used for emptying the collecting space.

15 Claims, 1 Drawing Sheet

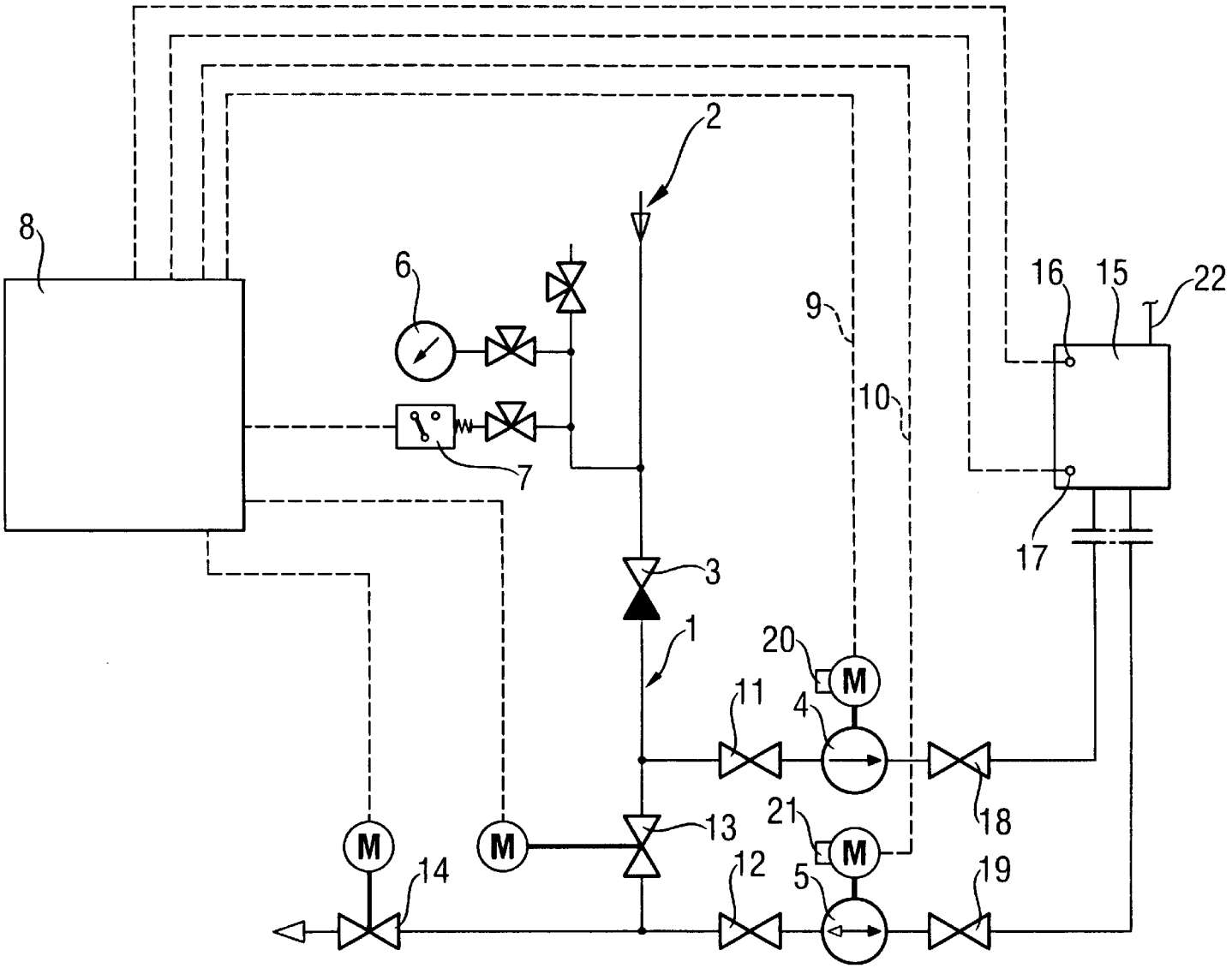
22
15
16
17
18
19
10
9
20
4
21
5
11
12
2
3
1
13
7
6
14
8
M

VACUUM SYSTEM

FIELD OF THE INVENTION

The invention relates to methods and apparatus for transporting sewage in a vacuum system.

BACKGROUND OF THE INVENTION

In the publication EP 0 333 045 there is disclosed a method for transporting sewage from a source of sewage through a sewer network to a sewer or collecting container. The transport takes place by means of and through a liquid ring pump, whereby the liquid ring pump is on-line with the sewer network or sewer piping. This known solution is, however, susceptible to disturbances and requires additional means for ensuring its function. The liquid ring pump has a complicated structure and it is easily damaged and furthermore it constantly requires additional water for maintaining the liquid ring as well as for for cooling. The additional means and the components related thereto increase room requirement and increase weight, whereby the locations where the known solution can be used are defined by the availability of additional room and by limitations caused by the additional weight.

SUMMARY OF THE INVENTION

The object of the present invention is to achieve a method, by which the above mentioned disadvantages are avoided and which provides an efficient operation of the vacuum system by simple means.

The invention is based on the idea to achieve a compact solution, which can be used for transporting sewage during the vacuum phase as well as during the subsequent transporting phase. The solution also has to have tolerance with regard to the composition and quality of the sewage. This object is attained by using a rotary lobe pump arranged on-line with the sewer piping as a transport means.

The invention advantageously employs two rotary lobe pumps, which may be operated alternately, at the same time or independently of each other for generating vacuum in the sewer piping. This provides for example for keeping the wear of the pumps equal and for ensuring additional capacity for vacuum generation.

By defining the control of the rotary lobe pump so that it at a predetermined occurrence changes the direction of rotation of the rotary lobe pump, the pump can advantageously, in addition for generating vacuum, for example also be used for emptying sewage from a temporary collecting container or for removing a disturbance, for example a blockage, in the flow of the pump, whereby it is not necessary to stop the pump, which would have a decisive effect on the usability and function of the sewer piping.

The filling an emptying of the temporary collecting container is advantageously controlled by monitoring its filling degree.

Disturbances, for example the above mentioned blockages, in the through-flow of the rotary lobe pump, are advantageously monitored on the basis of the power consumption of the pump. A blockage temporarily raises the power consumption of the pump, whereby the direction of rotation of the pump may temporarily be changed for certain periods of timer to clear the blockage. This can be arranged to be repeated, for example 2 to 8 times. If the blockage is not removed at this stage, the pump can be stopped for required measures. The number of changes of the direction of rotation are as such not in any way limited.

The power consumption of the rotary lobe pump can advantageously be monitored for example by following the consumption of electric current of the electric motor of the pump.

The vacuum system is advantageously controlled by and its operating parameters are advantageously monitored by a control center.

The invention also relates to a vacuum system, the main characterising features of which are given in claim 9 and preferable embodiments in claims 10–17.

BRIEF DESCRIPTION OF THE DRAWING

In the following the invention is explained in more detail, by way of example only, with reference to the FIGURE enclosed herewith, which is a schematic and simplified process diagram.

DETAILED DESCRIPTION OF THE PREFERRED EMBODIMENTS

The process diagram describes a vacuum system, which in this embodiment is a vacuum sewer system and in which by reference numeral 1 is indicated a sewer network or sewer piping. A source of sewage, which for example comprises one or more toilet units, a wash basin or the like, and which is not shown in detail, of the sewer piping is indicated by reference numeral 2. The source 2 of sewage is separated from the rest of the sewer piping 1 by a backflow valve 3. The sewage may comprise grey water, i.e. for example waste water and/or solid waste coming from a wash room, and black water, i.e. for example waste water and/or solids coming from a toilet unit.

At the sewage source 2 end of the sewer piping 1 a predetermined vacuum level is maintained, preferably in the range of about 0.3 to 0.6 bar (absolute pressure about 0.7 to 0.4 bar), by means for generating vacuum, i.e. two parallel-coupled rotary lobe pumps 4,5. When the vacuum in a normal situation decreases, for example when flushing a toilet unit, only one of the pumps 4,5 is started in order to reinstate the vacuum to a predetermined level. The pumps 4,5 are advantageously used alternately in order to keep the wear of the pumps equal. If the vacuum falls for example below about 0.3 bar (absolute pressure higher than about 0.7 bar) both pumps 4,5 are started in order to reinstate the desired vacuum level. The pumps 4,5 are provided with electric motors M.

The pressure level of the sewer network 1 can be controlled for example by a pressure gauge 6. A pressure transducer 7, which is connected to a control center 8, by means of which the above discussed starting and stopping automation of the pumps can be controlled for example with a preset program, is advantageously also used. By means of the control center 8 the putting into operation of the pumps 4,5 can also be chosen on the basis of the temperature of or the operating time of the pumps, for example so that either the pump that is cooler or the pump that has been operating for a lesser time is started in order to generate vacuum according to need. The connection of the electric motors of the pumps 4,5 to the control center 8 is shown by broken lines 9,10.

The transport of waste for example from a toilet unit to the collecting or discharge space for sewage is described in the following. By the collecting or discharge space is for example meant a collecting container 5, usually a temporary collecting container, a sewage treatment plant, a sewer or a free discharge space. The flush function of the toilet unit is activated, whereby the sewer valve of the toilet unit leading to the sewer piping 1 is opened, and the atmospheric pressure prevailing at the toilet unit pushes the sewage into the sewer piping 1 under vacuum, after which the sewer valve is closed. The motor valve 13 is kept closed, whereby the sewage is sucked to the rotary lobe pump 4 through the shut-off valve 11 and is further transported by means of the rotary lobe pump 4 for example to the sewage collecting container 15. At the next use of the toilet unit the other rotary lobe pump 5 may for example be used, whereby the shut-off valve 11 is closed and the motor valve 13 opened, so that the sewage flows through the shut-off valve 12 and the rotary lobe pump 5 to the sewage collecting container 15. The lines between the collecting container 15 and the rotary lobe pumps 4,5 are provided with shut-off valves 18,19. The collecting container 15 is provided with an air inlet 22 in order to maintain atmospheric pressure in the collecting container.

Instead of to a collecting container the sewage may be transported directly to a sewage treatment plant or to a free discharge space.

The generation of vacuum and the sewage transport process may be optimized in the above disclosed manner.

The capacity of the collecting container usually is limited, whereby it has to be emptied from time to time. This can be arranged so that at least one of the rotary lobe pumps is also used for emptying the collecting container. When the collecting container 15 is filled to a certain filling degree, i.e. to an upper filling level defined by a high level switch 16 connected to the control center 8, the motor valve 13 is closed, whereafter the motor valve 14 is opened. The second rotary lobe pump 5 is started and it is set to rotate in a second direction of rotation, which is opposite to a first direction of rotation used for generating vacuum, whereby the collecting container 15 is emptied by the rotary lobe pump 5 through the open motor valve 14 for example to a sewage treatment plant or a free discharge space (indicated by an arrow, not shown). The emptying phase is terminated when a lower filling level of the collecting container 15 defined by a low level switch 17 is reached. The motor valve 14 is closed, after which the motor valve 13 is opened the rotary lobe pump is again set ready for generating vacuum in the sewer piping 1. The rotary lobe pump 4 is advantageously kept in a ready state for generating vacuum during the above described emptying phase.

The sewage may contain undesired solid particles which cause problems when the sewage is pumped through the rotary lobe pumps 4,5. In a situation like this blockages may occur in the rotary lobe pumps 4,5. One way to release such blockages is to change the direction of rotation of the blocked pump in question from the first direction intended for generating vacuum to the second direction of rotation opposite to the first direction of rotation and subsequently after a predetermined time again to the first direction of rotation. By the control center this operation, i.e. the change of the direction of rotation of the pumps, can be defined to be repeated for example 2 to 8 times. That is, the change of direction of rotation is done temporarily, for predetermined periods of time. If the disturbance is not removed, the pump or pumps can be stopped in order to clear up and remove the disturbance. An alternative for arranging the control is to monitor the power consumption of the pumps, for example by monitoring the consumption of electricity of the electric motors of the pumps by appropriate sensor means 20,21 connected to the pumps. The disturbances can also be monitored on the basis of the temperature of the electrical motor of the pump. If one of the pumps has to be stopped due to a disturbance, the other pump can be used both for generating vacuum as well as for emptying sewage from the collecting container 15. The motor valves 13,14 are provided with sensor means (not shown) connected to the control center for monitoring the opening and closing of the same.

In the above described example has been described the use of two rotary lobe pumps. It is clear that by appropriate control means one can also operate with one or more rotary lobe pumps all according to what is optimal in view of the sewer piping arrangement. Motor valves are suitable in view of control, but for example shut-off valves may be used instead. The operational parameters of the vacuum system can be registered in the control center, such as for example operation time of each pump, direction of rotation, temperature, power consumption, disturbance and failure information including points of time, the filling and emptying phases of the collecting container, and other corresponding information for managing the controlling and monitoring of the vacuum system.

In the above discussed example the vacuum system has been described in connection with a vacuum sewer system. Vacuum systems are also used in connection with supermarkets and corresponding arrangements, where in addition to the above also other types of waste material occur. The waste material may be grey water comprising for example waste material coming from meat and fish treatment facilities, which usually firstly has to be transported to a treatment plant before further transport. The material in question may also be condensate from refrigerators or freezers, which can be circulated back to be used for example as flush water for toilet units.

The sources of sewage may be located in fixed installations or in moving vehicles, for example in trains, vessels or airplanes.

The drawing and the description related thereto is only intended for clarifying the basic idea of the invention, whereby the invention in detail may vary within the scope of the ensuing claims.

What is claimed is:

1. A method for transporting sewage in a vacuum system having a source of sewage connected to a collecting space for sewage by sewer piping, and means for generating vacuum in the sewer piping, the method comprising arranging the means for generating vacuum in the sewer piping on-line with the sewer piping, using two rotary lobe pumps as the means for generating vacuum, and operating the two rotary lobe pumps alternately, at the same time, and independently of each other for generating vacuum in the sewer piping so that sewage is transported by way of the vacuum to the rotary lobe pumps and further through the rotary lobe pumps to the collecting space for sewage.

2. A method for transporting sewage in a vacuum system having a source of sewage connected to a collecting space for sewage by sewer piping, and means for generating vacuum in the sewer piping, the method comprising arranging the means for generating vacuum in the sewer piping on-line with the sewer piping, using a rotary lobe pump as the means for generating vacuum in the sewer piping so that sewage is transported by way of the vacuum to the rotary lobe pump and further through the rotary lobe pump to the collecting space for sewage, and changing the direction of rotation of the rotary lobe pump in response to a necessity to empty the collecting space, whereby the direction of rotation of the rotary lobe pump is changed in order to empty the collecting space.

3. A method according to claim 2, in which the necessity for emptying the collecting space is established by observing a filling of the collecting space to a certain filling degree.

4. A method for transporting sewage in a vacuum system having a source of sewage connected to a collecting space for sewage by sewer piping, and means for generating vacuum in the sewer piping, the method comprising arranging the means for generating vacuum in the sewer piping on-line with the sewer piping, using a rotary lobe pump as the means for generating vacuum in the sewer piping so that sewage is transported by way of the vacuum to the rotary lobe pump and further through the rotary lobe pump to the collecting space for sewage, and changing the direction of rotation of the rotary lobe pump in response to a disturbance in the flow of sewage in the rotary lobe pump, whereby the direction of rotation of the rotary lobe pump is changed temporarily, for a certain period, for removing the disturbance.

5. A method according to claim 4, in which an electric motor drives the rotary lobe pump and the disturbance in the flow of sewage in the rotary lobe pump is established by a power consumption of the electric motor, wherein a consumption of electricity of the electric motor is monitored.

6. A method according to claim 4, in which the direction of rotation of the rotary lobe pump is changed 2–8 times after one another for removing the disturbance.

7. A method for transporting sewage in a vacuum system having a source of sewage connected to a collecting space for sewage by sewer piping, and means for generating vacuum in the sewer piping, the method comprising arranging the means for generating vacuum in the sewer piping on-line with the sewer piping, using a rotary lobe pump as the means for generating vacuum in the sewer piping so that sewage is transported by way of the vacuum to the rotary lobe pump and further through the rotary lobe pump to the collecting space for sewage, and controlling the vacuum system and monitoring operating parameters of the vacuum system with a control center.

8. A vacuum system comprising a source of sewage, a collecting space for sewage, a sewer pipe connecting the source of sewage to the collecting space for sewage, and first and second rotary lobe pumps arranged on-line with the sewer piping for generating vacuum in the sewer piping, whereby the sewage is transported by way of the vacuum to the rotary lobe pumps and further through the rotary lobe pumps to the collecting space for sewage.

9. A vacuum system comprising a source of sewage, a collecting space for sewage, a sewer pipe connecting the source of sewage to the collecting space for sewage, and a rotary lobe pump arranged on-line with the sewer piping for generating vacuum in the sewer piping, whereby the sewage is transported by way of the vacuum to the rotary lobe pump and further through the rotary lobe pump to the collecting space for sewage, the rotary lobe pump being further arranged to empty sewage from the collecting space.

10. A vacuum system according to claim 9, in which a sensor means for monitoring a filling degree of the collecting space is connected to the collecting space.

11. A vacuum system comprising a source of sewage, a collecting space for sewage, a sewer pipe connecting the source of sewage to the collecting space for sewage, a rotary lobe pump arranged on-line with the sewer piping for generating vacuum in the sewer piping, whereby the sewage is transported by way of the vacuum to the rotary lobe pump and further through the rotary lobe pump to the collecting space for sewage, and a coupling connected to the rotary lobe pump for transporting sewage to and discharging sewage from the collecting space.

12. A vacuum system according to claim 11, in which the coupling is a coupling effecting starting of and direction of rotation of the rotary lobe pump.

13. A vacuum system according to claim 12, in which a sensor means for monitoring a power consumption of the rotary lobe pump is connected to the rotary lobe pump.

14. A vacuum system according to claim 13, further comprising a control center and a sensor means for monitoring a filling degree of the collecting space, in which the sensor means for monitoring a filling degree of the collecting space, said coupling of the rotary lobe pump, and the sensor means for monitoring the power consumption of the rotary lobe pump are connected to the control center.

15. A vacuum system according to claim 14, in which the control center is arranged to monitor operating parameters of the vacuum system.

* * * * *